US005934671A

United States Patent [19]

Harrison

[11] Patent Number: 5,934,671

[45] Date of Patent: Aug. 10, 1999

[54] PULL TAB TICKET GAME WITH BOTH AN INSTANT WIN AND BONUS AWARD SYSTEM

[76] Inventor: Joseph E. Harrison, 2541 Milford Rd., University Heights, Ohio 44118

[21] Appl. No.: 09/074,863

[22] Filed: May 8, 1998

[51] Int. Cl.[6] ..... A63F 3/06

[52] U.S. Cl. ..... 273/139; 283/903; 283/901

[58] Field of Search ..... 273/139, 138.1; 283/903, 901, 105, 103, 100, 98

[56] References Cited

U.S. PATENT DOCUMENTS

| | | | |
|---|---|---|---|
| 3,900,219 | 8/1975 | D'Amato et al. | 273/139 |
| 4,033,611 | 7/1977 | Johnsen | 273/139 |
| 4,943,090 | 7/1990 | Fienberg | 273/139 |
| 5,046,737 | 9/1991 | Fienberg | 273/139 |
| 5,092,598 | 3/1992 | Kamille | 273/139 |
| 5,158,293 | 10/1992 | Mullins | 273/139 |
| 5,193,815 | 3/1993 | Pollard | 273/269 |
| 5,217,258 | 6/1993 | Sanderson | 283/105 |
| 5,407,200 | 4/1995 | Zalabak | 273/139 |
| 5,419,592 | 5/1995 | Stuart | 283/102 |
| 5,671,921 | 9/1997 | Quinlan | 273/139 |
| 5,788,237 | 8/1998 | Fults et al. | 273/269 |

OTHER PUBLICATIONS

Flyer #1, Five window pull tab ticket.

Flyer #2, Five window "Bingo" pull tab ticket.

Flyer #3, Three window pull tab crisis–cross game ticket.

Flyer #4, Three window pull tab ticket crisis–cross game ticket having the cash payout printed directly under the pull tab.

Flyer #5 and #6, pull tab ticket game having insant win tickets and qualifying tickets for a seal prize.

Flyer #7, Pull tab ticket game haing instant win tickets and a progressive jackpot seal card.

Flyer #8, Pull tab ticket game having instant win tickets and a multi–level seal card.

*Primary Examiner*—Benjamin H. Layno

*Attorney, Agent, or Firm*—Pearne, Gordon, McCoy & Granger LLP

[57] ABSTRACT

A fund raising pull tab or break-open ticket game that provides the player a chance to win an instant monetary prize and qualify for a chance on the seal card prize or bonus board award on the same ticket, enabling the game operator full security and game integrity. Security and game integrity is achieved by printing a serial number which is assigned to a game set of tickets at two or more separate locations on the ticket. This would enable the game operator to separate an instant win/qualifier ticket into two or more separate parts should the player reveal symbols on the ticket indicating this to be an instant winning/qualifying ticket. The game operator would then separate the ticket, payout the instant win portion of the ticket, and retain it for accounting purposes. The player would keep the other half or remaining parts of the ticket until the qualifying bonus round of the game. The printing of the game set's serial number at two or more locations on the tickets would prevent fraudulent redemption of the ticket while enabling multiple chances for winning on a single ticket.

20 Claims, 3 Drawing Sheets

PULL TAB TICKET GAME WITH BOTH AN INSTANT WIN AND BONUS AWARD SYSTEM

BACKGROUND OF THE INVENTION

This invention relates to the field of games, and specifically to charitable fund raising games of chance for monetary prizes. In particular to a pull tab or break-open ticket game that utilizes a seal card.

Pull tab tickets are well known devices for fund raising as are bingo, Las Vegas nights or church raffles. These games are often used for their entertainment value in a social setting. These games are most often used by church groups, fraternal or social organizations, and youth groups in an effort to raise funds.

Pull tab tickets, also known as break-open cards, are easy to use by both the sponsoring organization and the players. Properly designed and manufactured, quality control can be exercised to provide a consistent result with safeguards against cheating and misuse/abuse. One technique used for prevention against cheating and/or misuse and abuse is to provide a serial number on the ticket face. This serial number would comprise a common set of numbers printed on each ticket for a single game set or deal. Thus, the operator need only to check the serial number of a ticket turned in for receipt of a prize in a certain game to determine if the ticket belonged to that particular game set or deal.

Pull tab tickets provide opportunities for multiple chances by providing multiple windows on a single ticket. Ticket manufacturers customize games for regional play styles, and offer promotional material to enhance player interest. Break-open cards or pull tab games are inexpensive for a game operator to buy. They offer a handsome profit when a set or pack of tickets has been sold to the players and all monetary prizes paid out.

A typical game ticket identifies multiple instant winners through the use of winning combinations of game symbols when the individual ticket windows are opened by the players. The winning symbol combinations are usually predetermined and are advertised in connection with the sales of the tickets, whereby the players are seeking those symbol combinations.

Another play style used in the sale of pull tabs or break-opens is the seal card game. A popular type of seal card game involves a multiple number of players having a series of unique numbers or symbols printed under the break-open windows of their tickets to qualify. These players are entitled to participate in a bonus or advance level of play, a seal card being provided with one of the aforementioned series of unique numbers or symbols printed under a seal which is opened at the conclusion of play to determine the seal winner.

Thus, the purchase of one of these currently available tickets results in one of three possible outcomes: qualification for a seal game, an instant cash prize, or a non-winner.

Due to a lack of security features on the pull tab or break-open ticket, manufacturers or printers have been unable to make a pull tab with BOTH an instant monetary winner AND qualifier for the seal prize. When a pull tab ticket is redeemed for a monetary prize, the operator takes possession of the card from the player, insuring that it is not redeemed fraudulently a second or third time. If the game ticket identifies a qualifier for the seal prize, the player must retain the qualifying ticket until the conclusion of the game and the winner is identified.

U.S. Pat. No. 5,158,293 to Mullins discloses a lottery game ticket which combines an instant play lottery game ticket on one side of the ticket and a jackpot lottery game ticket on the other side of the ticket. The instant play side of the ticket may be removed from the jackpot side of the ticket so that a prize pay-out may be received if that ticket is a winner. The jackpot lottery side may be retained by the purchaser until a later date when the lottery will be drawn via a selection of randomly drawn numbers. The number of winners for the jackpot lottery would vary depending upon the number of tickets having the matching set of winning numbers. Both sides of the ticket contain a registration number for verification purposes.

The pull tab seal card game of the present invention provides for an enhanced level of play action by providing the player the chance to win both an instant monetary prize and the chance of qualifying for the seal card play through the purchase of a single ticket.

SUMMARY OF THE INVENTION

The present invention provides a ticket game having both an instant win and a bonus award system. These types of ticket games are typically used at fund-raising or charitable events but could be used for other types of events. The ticket game of the invention provides the player a chance to win an instant monetary prize in addition to a chance to qualify for a seal card prize or a bonus board award on the same ticket while providing the game operator full security and game integrity. Each game set comprises a plurality of tickets such as 50, 100, 150, or more tickets and each of these game sets have a predetermined number of tickets which are instant winning, bonus qualifying, a combination of both and non-winning. Each game set of tickets is assigned a serial number for the entire set of tickets and each ticket within that particular game set of tickets has this same serial number printed on it.

The feature of this invention of producing game sets having at least one ticket within a set that is a combination of both an instant winner and a qualifier is achieved by printing the serial number assigned to the game set at least at two separate locations on the ticket. These locations typically include the top and the bottom of the ticket face but can also include other locations on the ticket such as at the sides of the ticket face, at any location of the back of the ticket, or beneath removable concealing means on the ticket.

In the practice of the present invention, a multiple-contestant seal card game is provided which includes a plurality of individual playing tickets all identified by a common serial number. All tickets include graphical and/or numerical symbols or a combination of these symbols printed on the inner surface and concealed by break-open windows. Some of the cards are non-win. Some of the symbols or combination symbols are instant monetary winners or qualifiers for advanced seal card play, while others are both instant winners and qualifiers for advanced seal card play. The players with game cards with both instant monetary win and seal qualifiers will offer the ticket to the game operator for instant prize payoff. The operator will tear or rip off a part of the ticket, such as an instant win part, pay the player the correct instant monetary prize, and return the other part or parts of the game ticket with the qualifying number or symbol thereon to the player so that the player may retain the ticket until the qualifying seal round.

With the instant win part of the ticket in his possession, the game operator or any staff member will note that ticket marked as paid, assured of both an accurate accounting of the game, and no chance for fraudulent redemption. The player has won both an instant monetary prize and retains a part or parts of the game ticket qualifier for the seal prize, and possibly other additional prizes.

A currently used pull tab or break-open seal card game offered the players three possible options when the players procure a game ticket from the operator and open the windows. 1) The player cannot identify winning symbols or symbol combinations and has a losing card. 2) The player identified winning symbols or symbol combinations on a instant win ticket. 3) The player identified unique symbols or symbol combinations which qualifies the ticket for a seal prize round.

The present invention provides a pull tab or break-open game ticket that combines the elements of both a instant monetary win AND a seal card or jackpot qualifier on a single pull tab or break-open ticket.

The drawings are for the purpose of illustrating the invention and should not be used to limit the scope of this invention. For example, the drawings illustrate pull tab tickets or break-open cards with two parts but in fact such tickets could contain three, four, or more parts, each part containing the same serial number, so that each part could be removed separately and the player may qualify for a multiplicity of awards. Also, note that the tickets of the invention can include any number of pull tab windows and are not limited to five window games.

DETAILED DESCRIPTION OF THE INVENTION

Figure 1:
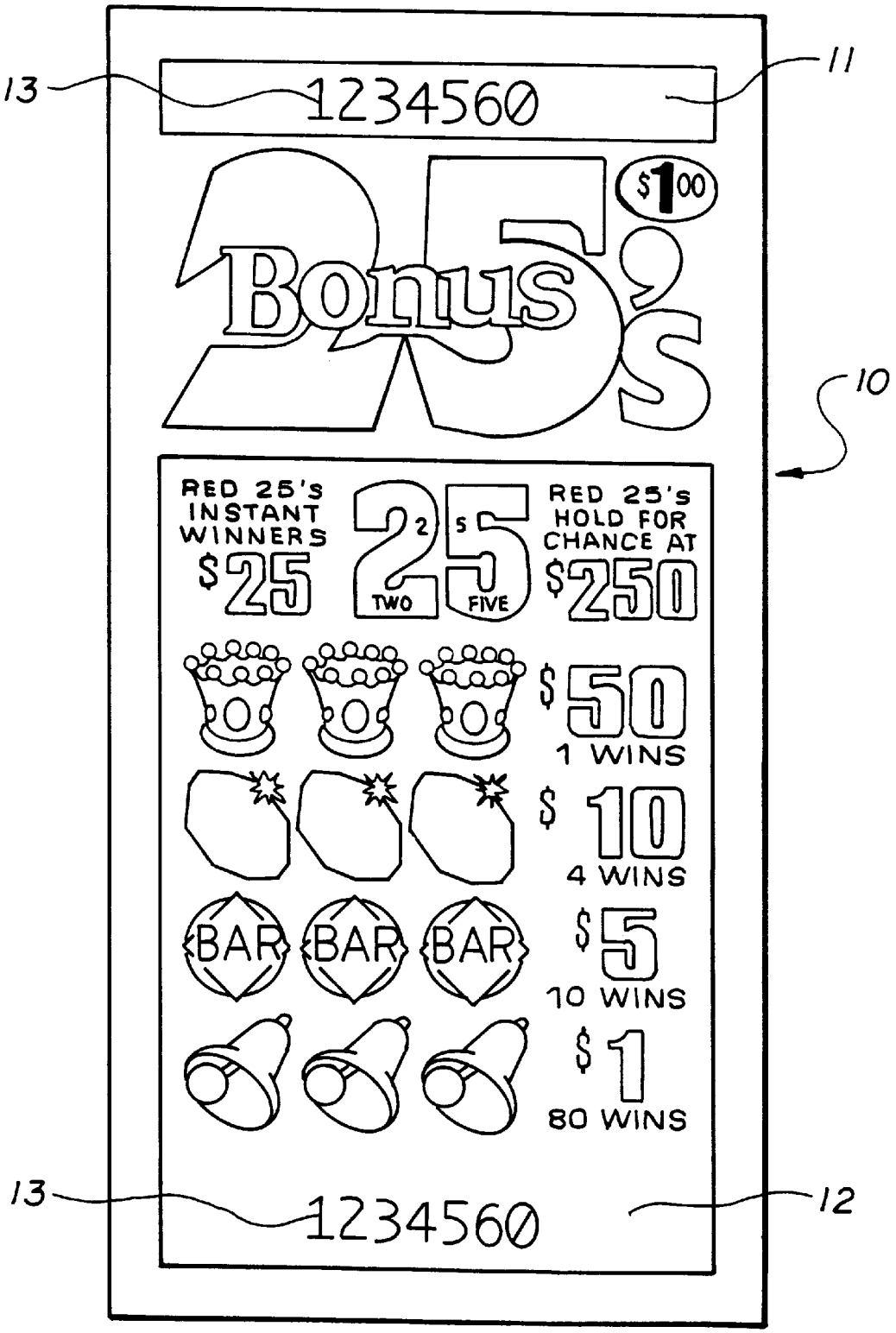
FIG. 1 is a front elevational view of a pull tab ticket or break-open card embodying the present invention.

Referring to FIG. 1, the pull tab or break-open ticket 10 has two serial number registration locations 11, 12 containing the same serial number 13 printed by the manufacturer to identify that particular game set or deal of tickets. Manufacturers print a serial number 13 on every ticket to identify that ticket belonging to an individual game set or deal. Some state agencies require by law the manufacturer to print and record game serial numbers for tracking purposes to reduce or eliminate the chance of fraudulent play or evasion of tax payments. To the game operator the serial number 13 is very important as it eliminates the chance of unauthorized tickets coming into their game for fraudulent redemption.

Figure 5:
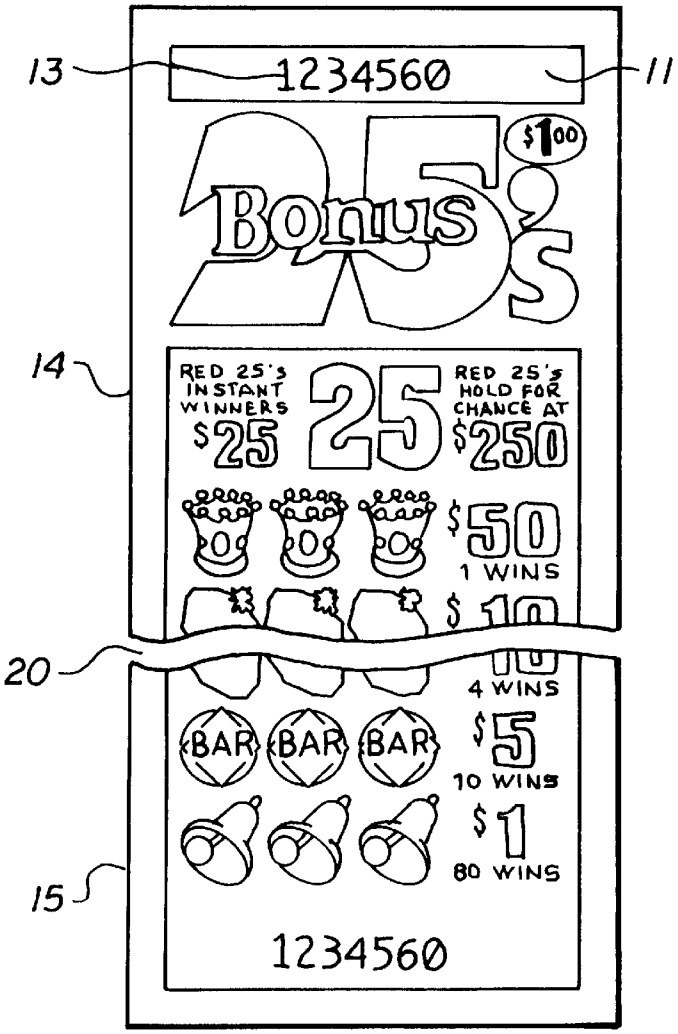
FIG. 5 is a front elevational view of an individual pull tab ticket showing a defaced ticket, embodying the present invention, and illustrating the security feature offered to the game operator when redeeming a instant monetary prize and taking possession of half of the pull tab ticket and offering the player the ability to retain the qualifier portion of the pull tab ticket for the advance play of the seal card.
Figure 4:
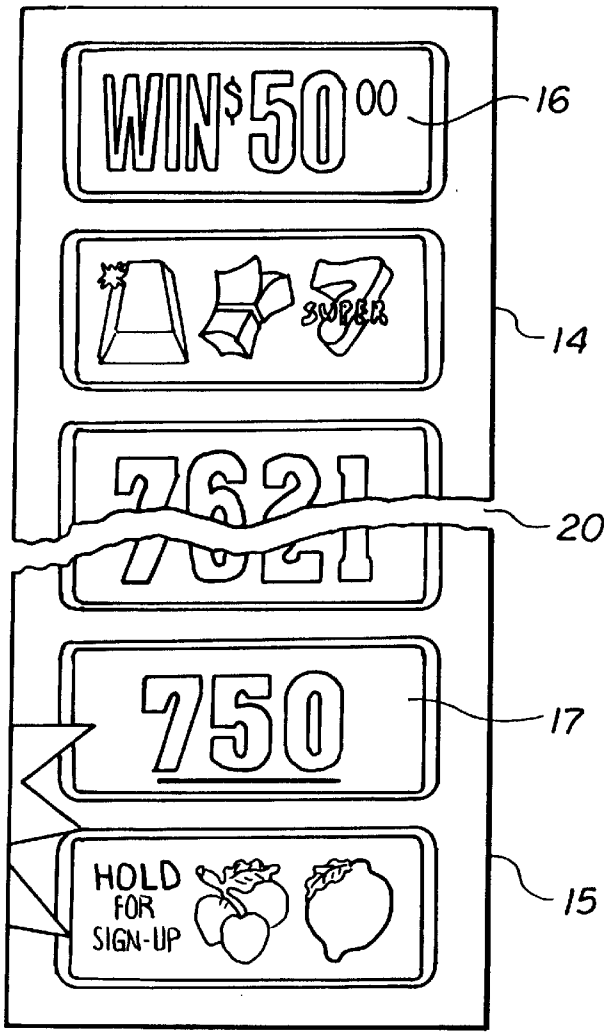
FIG. 4 is a rear elevational view of an individual pull tab ticket showing a defaced ticket, illustrating the instant win monetary half of the ticket and the qualifier for the seal prize.

The unique element of the present invention is the addition of the second serial number location 11 whereby the manufacturer will print the same serial number 13 at both locations on one game ticket 10. The addition of the second serial number registration location 11 containing the game identifying serial number 13 will facilitate the game operator to redeem instant win game tickets for a monetary prize as shown in FIGS. 4 and 5, by separating the ticket at 20 into two parts and retaining one half of the game ticket 14 with the correct monetary amount printed on the ticket 16 that was paid to the player. That one half of the ticket 14 contains a serial number registration location 11 with the game identifying serial number 13 printed at this location. The player whose ticket also is a qualifier for the bonus round can then retain the other half of the ticket 15 until the bonus round has been played because this other half of the ticket 15 also contains a serial number registration location 12 having the same game identifying serial number 13 printed thereon as that of the instant win half of the ticket 14.

Figure 3:
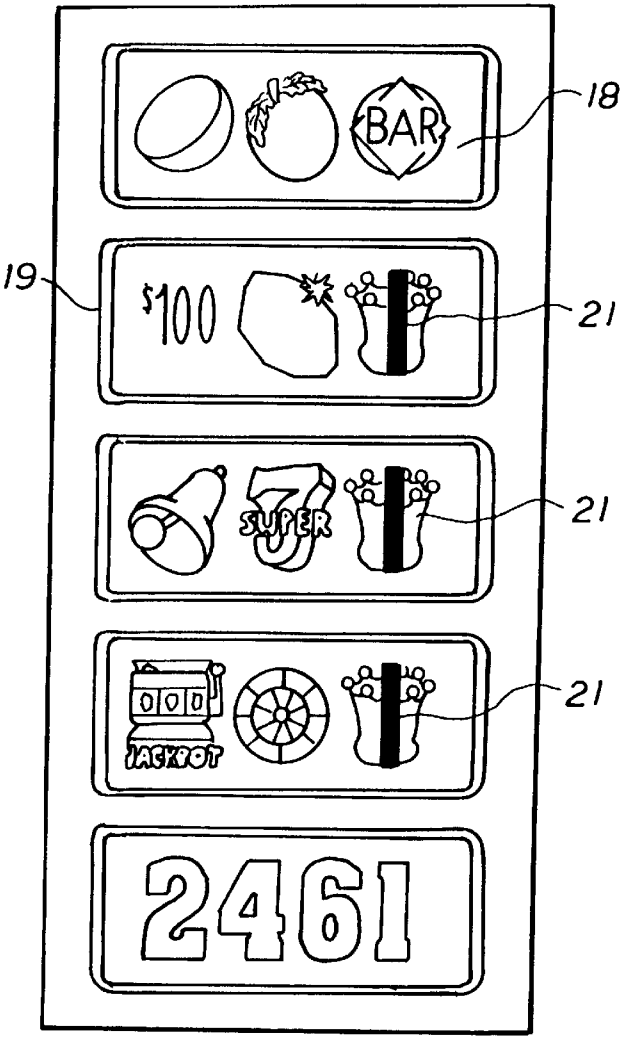
FIG. 3 is a rear elevational view of an individual pull tab ticket showing a different set of symbol combinations revealed.
Figure 2:
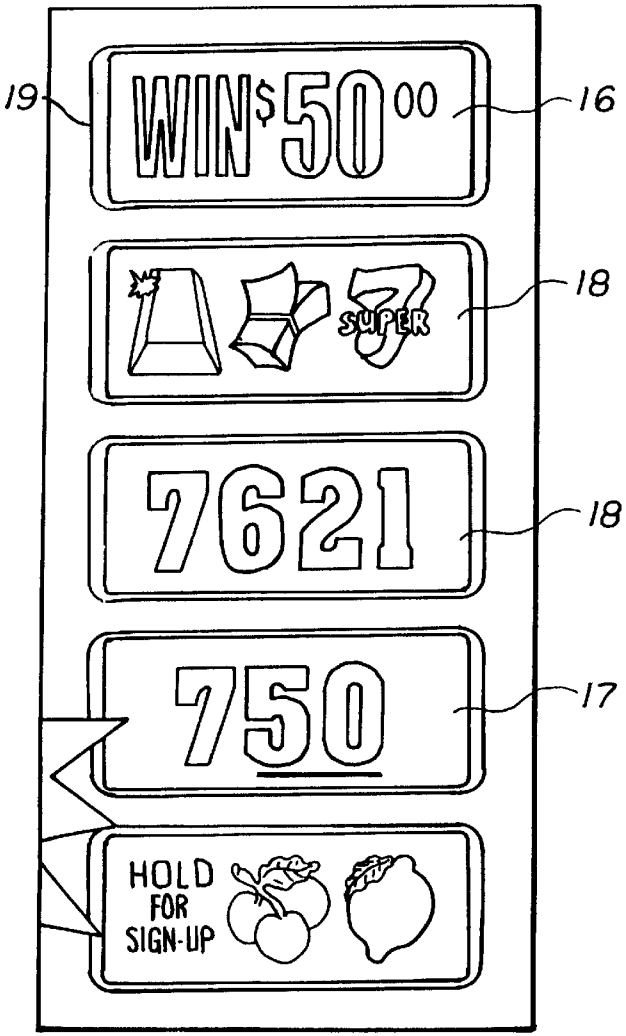
FIG. 2 is a rear elevational view of an individual pull tab ticket showing the symbol combinations revealed, embodying the present invention.

FIGS. 2 and 3 show examples of individual pull tab tickets wherein the pull tabs 18 have been removed, such as by the player or ticket purchaser, to reveal the ticket's graphical and/or numerical symbol combinations at windows 16, 17, and 18. The symbol combinations within these windows can indicate an instant winner 16, a qualifier for the seal card or bonus round 17, or a non-winning/non-qualifying combination 18. For example, symbol 17 points to a window having a symbol combination of "750". The "50", which is underlined in FIG. 2, represents a qualifying symbol for this particular game. The particular qualifying, as well as the instant winning symbol combination, can vary as desired and the symbols used for the games may be customized to a particular region, event, or the like. Note that the invention is not limited to a symbol "combination" but would also encompass tickets having a single symbol representing an instant winner, qualifier, or non-winner. Also, an instant winning or qualifying symbol combination does not need to be contained within a single window but can be formed by a row or series of symbols extending in a variety of directions such as shown for example in FIG. 3, element 21. Although, the figures shown herein depict five window pull tab games, the present invention can be applicable to any number window pull tab games such as two window, three window, four window, and the like. The present invention could also be applicable to single pull tab window games wherein the removal of the pull tab would reveal at least two rows of graphical and/or numerical combinations.

An alternative type of single pull tab window ticket could have a unique symbol (or symbol combination) signifying both an instant win and a qualifying ticket. The payout or qualification round for this alternative ticket would require ripping of the ticket such that at least a part of the ticket containing the serial number registration location with the serial number thereon is removed by the game operator for accounting purposes and another part of the ticket also having the serial number registration location and serial number thereon is retained by the player for the qualification round. The instant win/qualifier symbol would remain with the part of the ticket that requires this particular symbol for an instant win payout or for qualification for the bonus round.

Also, note that the qualifier combination should not be limited to its use in a seal card game but could be used in a bonus round wherein the winner is determined via a raffle or a drawing. Additionally, the invention should not be limited to tickets wherein the instant win combination and the qualifier combinations are printed at specific locations or under specific window tabs on the ticket. For example, the instant win combination could be printed on the bottom of the ticket and the qualifier could be printed at the top or in the middle of the ticket.

As previously stated and shown by FIGS. 4 and 5, the pull-tab ticket 10 of the present invention contains a second serial number registration location 11 whereby the manufacturer will print the same serial number 13 at both locations 11, 12 on one game ticket 10. The addition of the second serial number registration location 11 containing the game identifying serial number 13 will facilitate the game operator to redeem instant win game tickets 14 by separating this portion of the ticket at 20 as outlined above, and allowing the player to retain the other half of the game ticket 15 with the correct number or symbol 17 qualifying the player for the advance seal play or bonus round. That half of the ticket also contains a serial number registration location 12 with the game identifying serial number printed 13 within. The separation 20 of the instant winning portion of the game ticket from the qualifying portion may be done by ripping or cutting of the ticket. Additionally, perforations in the ticket itself may be provided by the manufacturer to facilitate this separation.

The present invention has been described as teaching the use of two registration locations having the same serial number printed at these locations on the ticket. However, more registration locations having this same serial number printed thereat may be present on the ticket such that the ticket may be separated into a plurality of parts, each part having this serial number printed thereon. This type of ticket could be used in a game having multiple levels of play. These multiple levels of play could include multiple qualifying rounds and/or could include multiple bonus awards for the winner of each level. After a qualifier and/or winner has been determined at a particular level of play, a part of the ticket having the symbol for this level alongwith the game's serial number printed thereon could be removed and the remaining portion of the ticket could be retained by the player for the next level of the bonus round.

Also, the locations at which the serial number is printed on the ticket can vary. For example, one or more of these locations could include the sides or middle of the ticket face, the back of the ticket, or even beneath one or more of the concealing means or pull tabs. It the location is beneath the concealing means or pull tabs, then this serial number would be revealed upon removal of the concealing means so that they would be visible at the time that the ticket is redeemed.

Also note that the serial number comprises a number of not less than 5 digits and that the registration location typically comprises a box which is back printed with a screen print of a dot-matrix which eliminates the chance for alteration of the serial number. The requirements for the serial number and the registration box are set forth by the North America Gaming Regulators Association (N.A.G.R.A.) which is a large association of Federal, State, County, and Local policing agents that meet twice yearly to share information on the gaming industry. The gaming industry is made up of but not limited to casino, lottery, river boat, Native American, bingo and keno, charitable fund raising, and in some cases, horse racing. NAGRA is an important association and its very existence ensures integrity within the gaming industry.

NAGRA has written and publishes manufacturing standards for the manufacture or printing of pull tab or break-open tickets. To obtain a license in a given state, a pull tab or break-open ticket printer must comply with NAGRA standards for the printing of pull tab tickets. As stated above, one of the NAGRA standards mandates the manufacturer to print an identifying serial number of not less than 5 digits on the ticket face within a registration box, said registration box should be back printed with a screen print of a dot-matrix, which will eliminate the chance for alteration of the serial number. The present invention meets the requirements of NAGRA.

While the present invention has been described in relation to pull tab or break-open games, the invention could be applicable to other types of ticket games in the fund-raising industry having concealed information thereon, such as scratch off games or the like wherein the game set or deal is monitored via a serial number registration system such as described above.

Having described and illustrated the principles of the invention with reference to preferred embodiments, it will be recognized that the invention can be modified in arrangement and detail without departing form the spirit and scope of this invention. Accordingly, all such modifications and changes as fall within the scope of the appended claims are intended to form part of this invention.

I Claim:

1. A ticket game having an instant win and a bonus award system comprising:

a game set of tickets having a plurality of tickets and a serial number assigned to said set of tickets wherein said serial number is the same for all of said tickets in said game set;

each of said tickets in said game set having two or more registration serial number locations on the ticket and having said serial number printed at said locations;

each of said tickets having graphical and/or numerical symbols printed thereon with each of said tickets including a removable means for initially concealing said symbols;

at least some of said symbols in said game set representing an instant win and/or a bonus qualification and wherein upon removal of said concealing means, at least one ticket of said game set displays both an instant win and a bonus qualification symbol printed on said ticket.

2. The ticket game as recited in claim 1 wherein one of said registration locations is positioned at the top of the ticket face and the other of said registration locations is positioned at the bottom or side of the ticket face.

3. The ticket game as recited in claim 1 wherein at least one of said registration locations is positioned beneath said removable means.

4. The ticket game as recited in claim 1 wherein said at least one ticket displaying both an instant win and a bonus qualification symbol is capable of being separated into first and second parts such that said first part displays the instant win symbol and one of said registration serial number locations and said second part displays the bonus qualification symbol and another of said registration serial number locations.

5. The ticket game as recited in claim 1 wherein said at least one ticket displaying both an instant win and a bonus qualification symbol is capable of being separated into three or more parts such that each part displays a registration serial number location and a symbol representing a level of play.

6. The ticket game as recited in claim 1 wherein said removable means comprises a pull tab which is removable to form a window wherein said window contains said symbol.

7. The ticket game as recited in claim 6 wherein said ticket comprises one or more windows.

8. The ticket game as recited in claim 1 wherein the game set includes a seal card for determining a winner of the bonus award.

9. The ticket game as recited in claim 1 wherein a winner of the bonus award is determined by a raffle or a drawing.

10. A fund raising pull tab ticket game comprising:

a game set of pull tab tickets, said game set of tickets having a serial number assigned thereto, said serial number being the same for each ticket within said game set and being printed at least at a first and a second location on each of said tickets in said game set;

each of said tickets having graphical and/or numerical symbols printed thereon with each of said tickets including one or more removable pull tabs for initially concealing said symbols;

at least some of said symbols in said game set representing an instant win and/or a bonus qualification symbol and wherein upon removal of said one or more pull tabs, at least one ticket of said game set including both an instant win and a bonus qualification symbol printed on said ticket such that said ticket may be separated into at least a first and a second part wherein said first part comprises said instant win symbol and said serial number printed at said first location and said second part comprises said bonus qualification symbol and said serial number printed at said second location.

11. The pull tab ticket game as recited in claim 10 wherein one of said registration boxes is positioned at the top of the ticket face and the other of said registration boxes is positioned at the bottom or at a side of the ticket face.

12. The pull tab ticket game as recited in claim 10 wherein at least one of said registration locations is positioned beneath at least one of said pull tabs.

13. The pull tab ticket game as recited in claim 10 wherein said ticket displaying both an instant win and a bonus qualification symbol is capable of being separated into three or more parts such that each part displays a registration serial number location and a symbol representing a level of play.

14. The ticket game as recited in claim 10 wherein the game set includes a seal card for determining a winning ticket from the bonus qualification tickets.

15. The ticket game as recited in claim 10 wherein a winner of the bonus qualification tickets is determined by a raffle or a drawing.

16. A method of playing a game employing a ticket having an instant win and a bonus award system comprising:

providing a game set of tickets having a serial number, which is assigned to the game set of tickets, printed at least at two separate locations on the ticket;

providing graphical and/or numerical symbols printed beneath concealing means on each of said tickets, at least some of said symbols representing an instant win or bonus qualification and providing at least one of said tickets with both instant win and bonus qualification symbols;

selling the tickets to players;

having said players reveal said symbols to determine if said ticket is an instant win, bonus qualification, or combination of an instant win/bonus qualification ticket;

separating any instant win/bonus qualification tickets into separate parts;

providing said player with an award for the instant win part of the ticket and retaining said instant win part for accounting purposes; and allowing the player to retain the other part or parts of the ticket until the qualifying bonus round of the game.

17. The method of playing a game as recited in claim 16 wherein said symbols are revealed by removing one or more pull tabs covering said symbols.

18. The method of playing a game as recited in claim 16 wherein a winner of the qualifying bonus round of the game is determined by the use of a seal card.

19. The method of playing a game as recited in claim 16 wherein a winner of the qualifying bonus round of the game is determined by a raffle or a drawing.

20. The method of playing a game as recited in claim 16 wherein said ticket may be separated into a plurality of parts, each of said parts including said serial number printed thereon, such that said ticket may be used for multiple levels of play.

* * * * *